US010597807B2

(12) United States Patent
Jiang et al.

(10) Patent No.: US 10,597,807 B2
(45) Date of Patent: Mar. 24, 2020

(54) FRONT-LOADING WASHING MACHINE HAVING ROTATABLE OBSERVATION WINDOWED DOOR

(71) Applicant: QINGDAO HAIER DRUM WASHING MACHINE CO., LTD., Qingdao, Shandong Province (CN)

(72) Inventors: Yuliang Jiang, Qingdao (CN); Guijun Shi, Qingdao (CN); Xizhan Gong, Qingdao (CN)

(73) Assignee: QINGDAO HAIER DRUM WASHING MACHINE CO., LTD., Qingdao (CN)

( * ) Notice: Subject to any disclaimer, the term of this patent is extended or adjusted under 35 U.S.C. 154(b) by 223 days.

(21) Appl. No.: 15/563,495

(22) PCT Filed: Mar. 28, 2016

(86) PCT No.: PCT/CN2016/077513
§ 371 (c)(1),
(2) Date: Sep. 29, 2017

(87) PCT Pub. No.: WO2016/155592
PCT Pub. Date: Oct. 6, 2016

(65) Prior Publication Data

US 2018/0087206 A1 Mar. 29, 2018

(30) Foreign Application Priority Data

Mar. 31, 2015 (CN) ..... 2015 1 0146827

(51) Int. Cl.
*D06F 37/10* (2006.01)
*D06F 39/14* (2006.01)
(Continued)

(52) U.S. Cl.
CPC ..... *D06F 37/10* (2013.01); *A47L 15/4261* (2013.01); *D06F 37/14* (2013.01);
(Continued)

(58) Field of Classification Search
CPC ..... D06F 37/10; D06F 37/28; D06F 39/14; E05D 7/04
See application file for complete search history.

(56) References Cited

U.S. PATENT DOCUMENTS 3,089,327 A 5/1963 Stilwell, Jr.

FOREIGN PATENT DOCUMENTS

CN 102677423 A 9/2012
CN 103328712 A 9/2013

OTHER PUBLICATIONS

CN102677423A Machine Translation (Year: 2012).*

* cited by examiner

*Primary Examiner* — Spencer E Bell
(74) *Attorney, Agent, or Firm* — Jiwen Chen; Jacobson Holman PLLC

(57) ABSTRACT

Provided is a drum-type washing machine having a rotatable viewing window comprising: a front panel of the housing of the washing machine, an access opening provided on the front panel, and a viewing window disposed on the access opening, wherein a hinge component is provided between the viewing window and the front panel of the housing to allow the rotation of the viewing window along a horizontal orientation and along a vertical orientation to the open position. When the viewing window opened to a small degree along the horizontal direction, it then could rotate upwards to open, and accordingly nearly half the space occupied by opening the viewing window of traditional front
(Continued)

loading washing machine could be saved. Furthermore, the automatic opening could be achieved.

8 Claims, 3 Drawing Sheets

(51) Int. Cl.

| | |
|---|---|
| ***E05D 7/04*** | (2006.01) |
| ***D06F 37/28*** | (2006.01) |
| ***A47L 15/42*** | (2006.01) |
| ***D06F 37/14*** | (2006.01) |

(52) U.S. Cl.
CPC ..... *D06F 37/28* (2013.01); *D06F 39/14* (2013.01); *E05D 7/04* (2013.01)

FRONT-LOADING WASHING MACHINE HAVING ROTATABLE OBSERVATION WINDOWED DOOR

This is a U.S. national stage application of PCT Application No. PCT/CN2016/077513 under 35 U.S.C. 371, filed Mar. 28, 2016 in Chinese, claiming priority of Chinese Application No. 201510146827.8 , filed Mar. 31, 2015, all of which are hereby incorporated by reference.

FIELD OF THE INVENTION

The present invention relates to the technical field of washing machine, and more particularly to a drum-type washing machine having a rotatable viewing window.

BACKGROUND OF THE INVENTION

A drum-type washing machine typically has a cabinet including a front panel with an access opening and a viewing window through which clothes are loaded and unloaded. As shown in FIG. 1, the opening angle of the viewing window is designed to be greater than 90° in the prior art, if the range of swing is less than 90°, it would be inconvenient for users to load and unload clothes. Typically, the washing machine is used in the kitchen or in the bathroom, it has been widely noted that people intends to leave much more space for washing machine on the top and on both sides, but as the space in front of the washing machine is limited, the viewing window may be blocked from opening sometimes. Many of the viewing windows have a diameter of 500 mm approximately, and that means, for avoid being blocked, it has to be set aside a space in front of casing with width larger than that of a viewing window, otherwise the viewing window is being prevent from opening to a fully opened position, and it would be uneasy for users load or unload clothes.

TECHNICAL PROBLEM

Accordingly, the present invention provides a drum-type washing machine having a rotatable viewing window to decrease the swing angle needed as opening the viewing window, and further save more space in front of the washing machine.

BRIEF DESCRIPTION OF THE INVENTION

In order to solve the above technical problem, the invention is realized by the following technical solution.

A drum-type washing machine having a rotatable viewing window comprises a front panel of the housing of the washing machine, an access opening provided on the front panel, and a viewing window disposed on the access opening, a hinge component is provided between the viewing window and the front panel of the housing to allow the rotation of the viewing window along a horizontal orientation and along a vertical orientation to the open position. As the viewing window initially rotates along the horizontal orientation and then rotates upwards or downwards along the vertical orientation, the viewing window is opened; as the viewing window initially rotates upwards or downwards along the horizontal orientation, the viewing window is closed.

Further, the hinge component includes a fixed mounting plate, a connecting arm, and a hinge shaft, wherein one end of the hinge shaft is provided with a second hinge and the other end of the hinge shaft is provided with a hinge shaft rotation limiting device.

Further, the second hinge includes a connecting arm provided with a rotating shaft at its end and a stopper groove provided at the outer end surface of the hinge shaft, the rotating shaft of the connecting arm is disposed in the stopper groove.

The hinge shaft rotation limiting device includes a brake arm and a stopper plate, wherein the brake arm is fixedly connected to the hinge shaft and the stopper plate is movably connected to the hinge shaft, and the stopper plate is fixedly connected to a fixed mounting plate. The hinge shaft is the center of vertical rotation for the viewing window, and the rotating shaft is the center of horizontal rotation for the viewing window.

The stopper plate is arranged at the back of the fixed mounting plate and the hinge shaft is embedded in the stopper plate, wherein the inner end surface of the hinge shaft is in alignment with the inner end surface of the stopper plate. The stopper plate is provided integrally with the fixed mounting plate and the stopper plate is thicker than the fixed mounting plate.

Further, the stopper groove is provided with a stop plane.

Further, a stop block is disposed between the rotating shaft and the stopper groove to prevent the viewing window from rotating back during the upward rotation.

Further, the stopper plate is provided with a first stopper and a second stopper for limiting the stopper plate, wherein the first stopper and the second stopper being located on both sides of the hinge shaft respectively, the first stopper is provided with a spring and a button and the button is arranged on the front panel of the housing of washing machine.

The button is used to retract or eject the first stopper. When the button is pressed, the first stopper protrudes from the inner end surface of the stopper plate; when the button is pressed again, the first stopper is retracted and returns to the position in alignment with the inner end surface of the stopper plate.

Further, one end of the brake arm is provided with a groove-shaped structure in which the first stopper is engaged with; when the brake arm is rotated to a proper position being blocked by the second stopper, one end of the groove-shaped structure happens to move to the position corresponding to the first stopper, then the button is being pressed and the first stopper ejects and blocks in the middle of the groove-shaped structure so as to prevent the viewing window from rotating.

Further, the fixed mounting plate is fixed inside of the front panel of the housing at the same side with the access opening.

Further, one side of the viewing window is provided with a handle.

Further, the hinge component is fixed on the front panel through the fixed mounting plate; and the viewing window is fixed on the connecting arm.

Further, the hinge shaft is provided with an electric device for automatically rotating the hinge shaft. The electric device arranged at the back of the fixed mounting plate comprises a stepping motor and a stepping driver, wherein the stepping motor is driven by the stepping driver and the signal for driving is a pulse signal.

The procedures for opening the viewing window comprise:

Step 1, opening the viewing window along a horizontal orientation; to be specific, opening the viewing window to a degree that the rotating shaft is blocked by the stop plane of the stopper groove on the hinge shaft;

Step 2, rotating the viewing window upwards: rotating the viewing window counterclockwise at the hinge shaft to drive the viewing window rotate upwards until a degree that most of the access opening could be seen to facilitate the unloading, or loading of clothes.

The stopper and auxiliary elements could prevent the viewing window from rotating back and enable the viewing window to be at chosen angle and keep stand still.

In order to save the space occupied by the viewing window of the front loading drum-type washing machine at the fully open position, the present invention discloses a drum-type washing machine having a rotatable viewing window, wherein the rotatable viewing window could open to a position with an opening angle less than 60°, and then rotates upwards to a degree that the access opening could be completely seen, also the viewing window could rotate downwards and returns to the original position after unloading or loading clothes.

Compared with the prior art, the advantages and positive effects of the present invention are:

According to the present invention, the hinge component is arranged on the viewing window. Therefore, when the viewing window opened to a small degree along the horizontal direction, the viewing window could rotate upwards to reduce the requirement of space in front of the washing machine. Furthermore, the automatic opening could be achieved.

DETAILED DESCRIPTION OF THE INVENTION

The invention will now be described in further detail with reference to the accompanying drawings and specific embodiments.

In the description of the present invention, it is to be understood that the direction or position indicated by the terms "back", "forward", "downward", "backward", "upward", "inside", "outside" is provided for the purpose of facilitating the description and simplifying, and not by way of illustration or implied means that the device or element must have a particular orientation and be constructed and operated in a particular orientation and therefore cannot be understood as limitation. In addition, the terms "first" and "second" are for descriptive purposes only and are not to be construed as indicating or imposing relative importance or implicitly indicating the number of technical features indicated.

In the description of the present invention, it is to be understood that the term "installation" and "connection" should be understood in a broad sense, unless otherwise specified and defined, for example, a fixed connection, a detachable connection, or connected integrally; also the connection can be a mechanical connection or an electrical connection; also can be directly connected, can also be indirectly connected through the intermediary, can be two components of the internal connectivity. The specific meaning of the above-mentioned terms in the present invention may be understood by those skilled in the art in light of specific circumstances.

Figure 1:
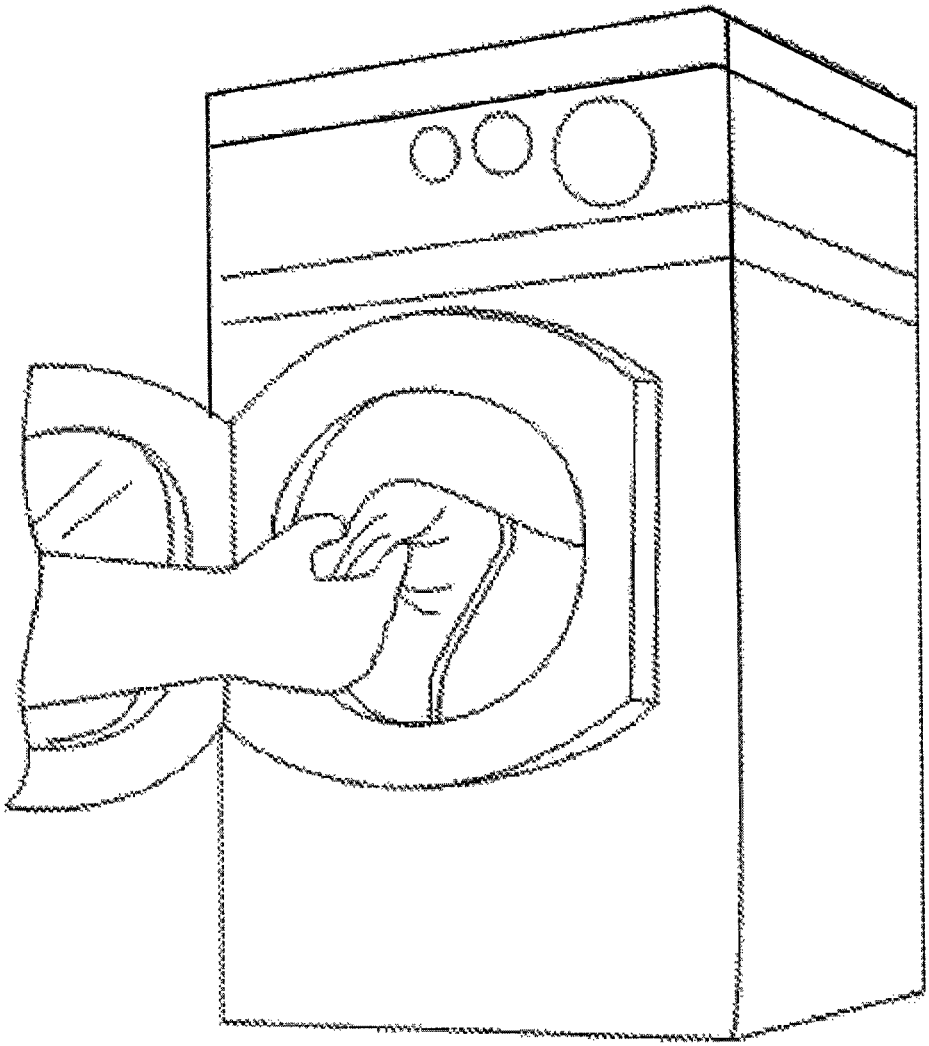
FIG. 1 shows the state that the viewing window of a traditional drum-type washing machine is being opened.
Figure 2:
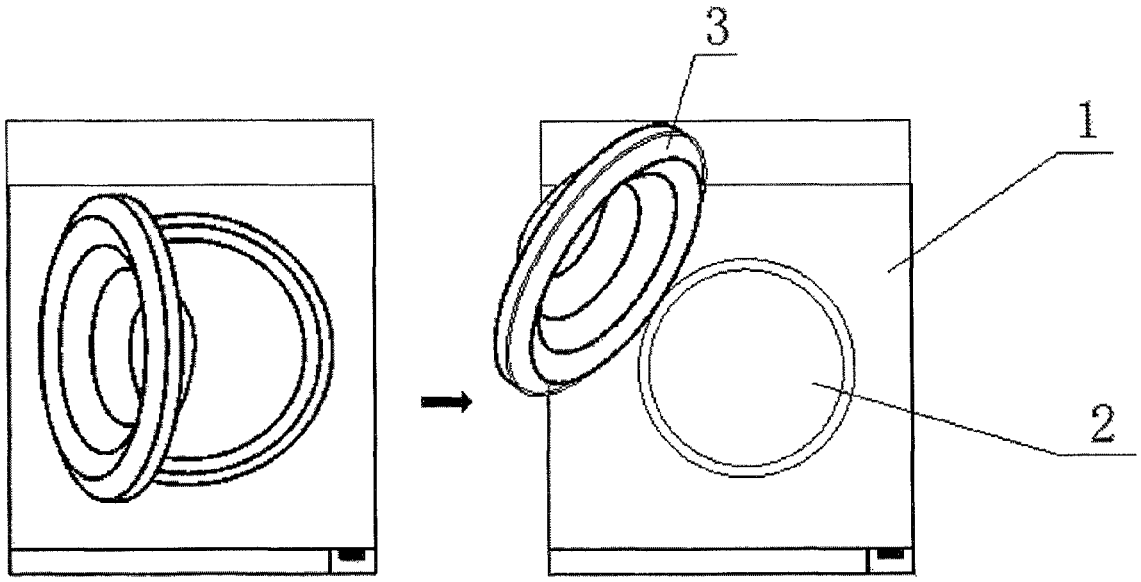
FIG. 2 is shows the process of opening the viewing window of drum-type washing machine according to the present invention.

Referring to FIG. 2, this embodiment discloses a drum-type washing machine having a rotatable viewing window, comprising a front panel 1 of the housing of the washing machine, an access opening 2 provided on the front panel 1, and a viewing window 3 disposed on the access opening 2. A hinge component is provided between the viewing window 3 and the front panel 1 of housing to allow the rotation of the viewing window 3 along a horizontal orientation, and also along a vertical orientation to the open position. As shown in FIG. 2, as the viewing window 3 initially rotates along the horizontal orientation and then turns with an upward or a downward circular movement, the viewing window 3 can be opened; as the viewing window 3 initially rotates downwards or upwards and then moves along the horizontal orientation, the viewing window 3 can returns to the close position.

Figure 3:
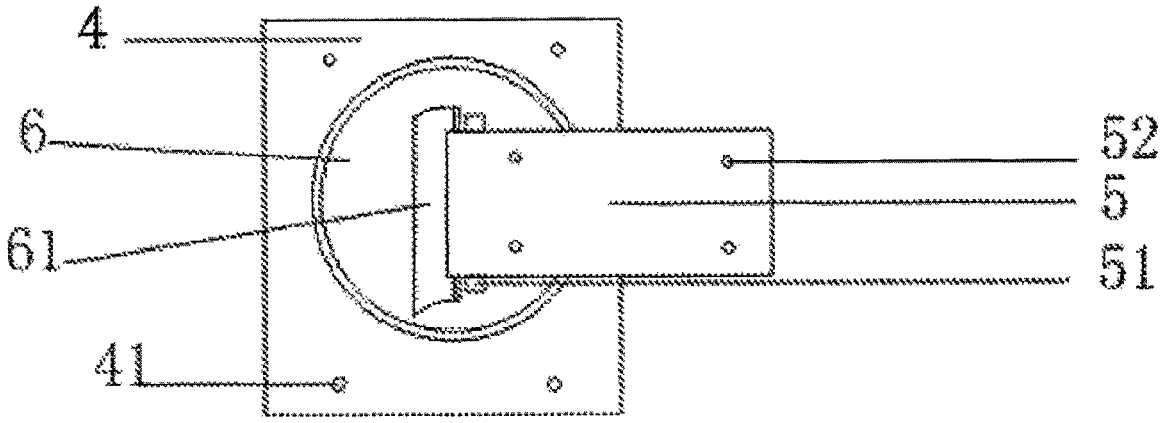
FIG. 3 is a front view of a hinge component of the drum-type washing machine according to the present invention.
Figure 4:
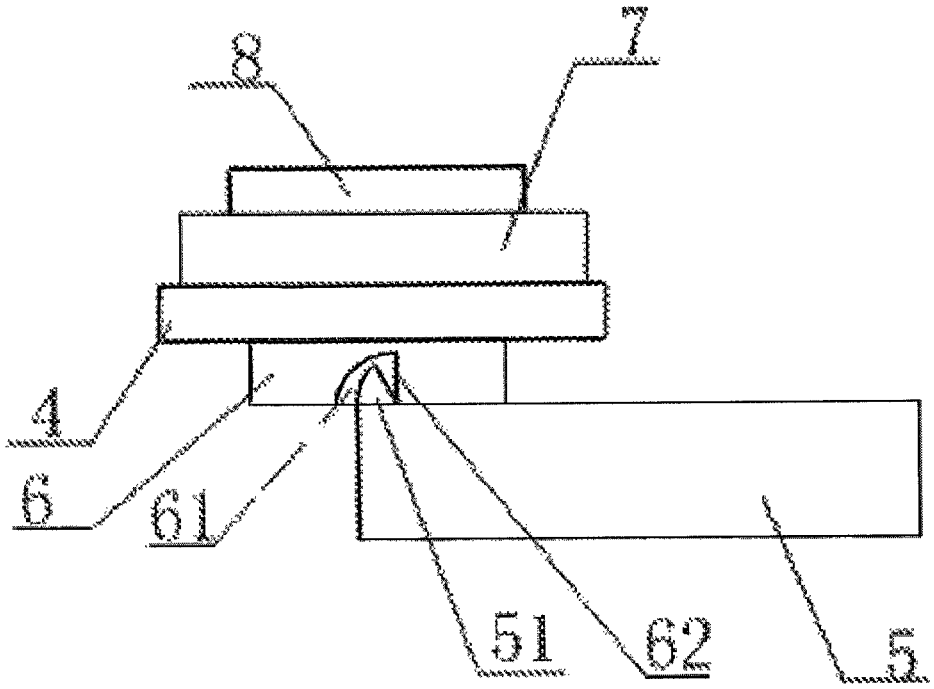
FIG. 4 is a top view of a hinge component of the drum-type washing machine according to the present invention.
Figure 5:
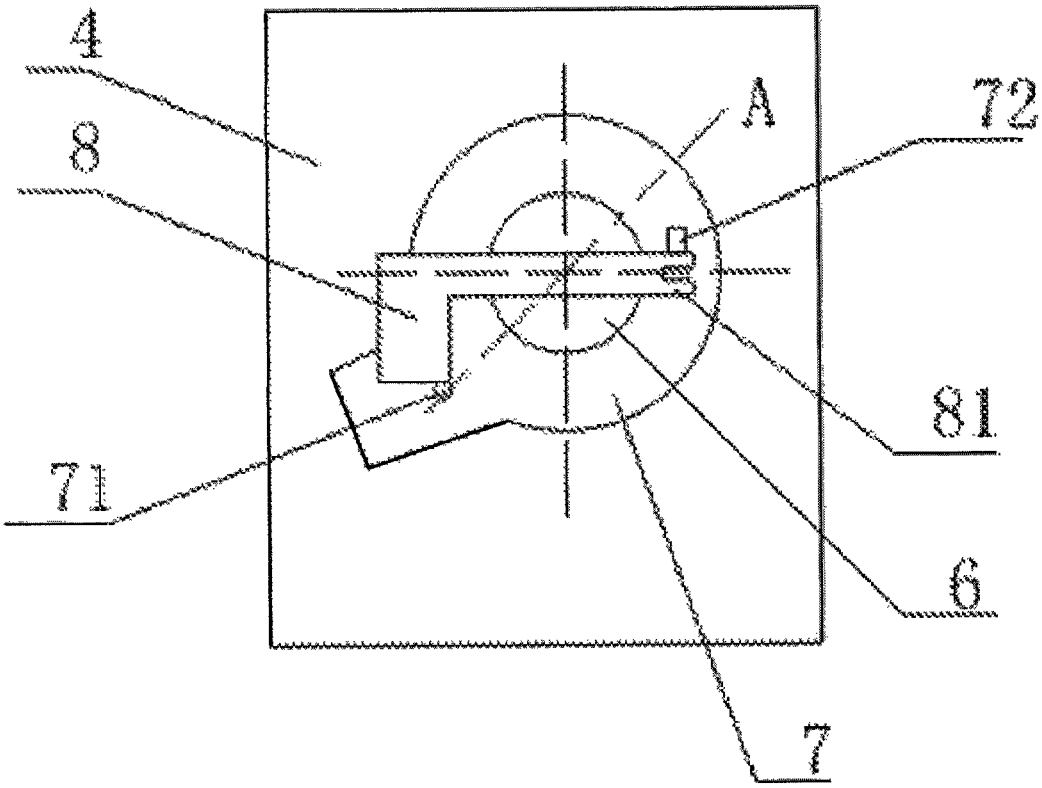
FIG. 5 is a rear view of a hinge component of the drum-type washing machine according to the present invention.

As shown in FIGS. 3-5, the hinge component includes a fixed mounting plate 4, a connecting arm 5, and a hinge shaft 6, wherein the fixed mounting plate 4 is fixedly connected on the inner surface of the front panel 1 of the housing. The rear surface of the fixed mounting plate 4 is provided with a stopper plate 7, the hinge shaft 6 passes through the fixed mounting plate 4 and the stopper plate 7 by means of a clearance fit, the viewing window 3 is fixedly connected on the connecting arm 5, and the hinge shaft 6 is the center of vertical rotation for the viewing window 3.

The fixed mounting plate 4 is opened with screw holes 41 and is screwed to the front panel 1 of housing. The connecting arm 5 is provided with screw holes 52 and the viewing window 3 is screwed to the connecting arm 5.

And the inner end surface of the hinge shaft 6 is in alignment with the inner end surface of the stopper plate 7, the stopper plate 7 and the fixed mounting plate 4 are integral, and the stopper plate 7 is thicker than the fixed mounting plate 4.

As shown in FIG. 4, the horizontal rotation of the viewing window 3 functions relying on the following structure. The outer end surface of the hinge shaft 6 is provided with a stopper groove 61, and the end portion of the connecting arm 5 is provided with a rotating shaft 51 which fits into the shape of the stopper groove 61. The rotating shaft 51 is disposed in the stopper groove 61. The rotating shaft 51 is the center of horizontal rotation for the viewing window 3. Inside the stopper groove 61 forms a stop plane 62 for restricting the angle range of the horizontal opening of the viewing window 3. Typically, the opening angle of the window door 3 is less than 50 degrees.

The procedures for opening the viewing window, as shown in FIG. 2, comprise:

Step 1 , opening the viewing window 3 initially along the horizontal orientation; to be specific, opening the viewing window 3 to a degree that the rotating shaft 51 is blocked by the stop plane 62 inside the stopper groove 61;

S2, rotating the viewing window 3 upwards: to be specific, rotating the viewing window upwards until a degree that most of the access opening could be seen to facilitate the unloading, or loading of clothes.

In the present embodiment, the viewing window 3 is horizontally opened at an angle of 40°, and the angle of counterclockwise rotation of the viewing window 3 along the hinge shaft is 120°.

The hinge component is provided with stopper and auxiliary elements for preventing the viewing window 3 from rotating back and enabling the viewing window to be at chosen angle and keep fixed.

In order to prevent the viewing window 3 in place from rotating, the hinge shaft 6 is provided with the stopper elements.

The stopper elements is shown in FIG. 5, the stopper plate 7 on the back surface of the hinge shaft 6 is provided with a first stopper 71 and a second stopper 72 respectively on both sides of the hinge shaft 6; the angle between a first connection line connecting the midpoint of the hinge shaft 6 and the first stopper 71 and a second connection line connecting the midpoint of the hinge shaft 6 and the first stopper 72 is 120°, wherein the first stopper 71 is provided with a spring and a button (not shown in Figs).The spring is located inside the fixed mounting plate 4 and the button is mounted on the front panel of the washing machine housing. The L-shaped brake arm 8 is fixedly connected on the inner end surface of the hinge shaft 6, and the first and second stoppers are used for limiting the brake arm 8. The function of the button and the spring is for controlling the retraction or ejection of the first stopper 71. When the button is pressed, the first stopper 71 is released and protrudes from the inner end surface of the stopper plate 7, when the button is pressed again, the first stopper is retracted and returns to the position in alignment with the inner end surface of the stopper plate 7.

A groove-shaped structure 81 is provided at one end of the brake arm 8, whereby the brake arm 8 can be easily blocked by the first stopper 71.

In order to facilitate the operation, a handle is provided on one side of the viewing window 3.

The vertical rotation of the viewing window 3 is realized by the following structure.

When the viewing window 3 is opened to a certain degree horizontally, the operator can rotate the viewing window 3 by the handle.

In the process of upward rotation, the first stopper 71 is retracted by pressing the button on the front panel 1 of the housing and then the viewing window 3 rotates, and the hinge shaft 6 drives the brake arm 8 to rotate. When the brake arm 8 moves to an a proper position A and is blocked by the second stopper 72, one end of the brake arm 8 with the groove-shaped structure 81 happens to move to the position corresponding to the first stopper 71, then the button is being pressed again and the first stopper 71 ejects and protrudes into the groove-shaped structure 81 so as to stop the viewing window 3 from rotating. User can load or unload clothes. Then after the operation, the first stopper 71 is retracted and the viewing window 3 is rotates clockwise to return to the horizontal level, and one end of the groove-shaped structure 81 is blocked by the second stopper 72, and the viewing window 3 is pushed forward for closing.

In order to reduce the space occupied by using the front loading type of drum washing machine, the present embodiment provides a rotatable viewing window structure in which the viewing window can be rotated, and the rotatable viewing window could open to a position with an opening angle less than 60°, and then rotates upwards to a degree that the access opening could be completely seen, also the viewing window could rotate downwards and returns to the original position after unloading or loading clothes. The space occupied by opening operation of the traditional front loading type could be saved.

As a further improvement of the present embodiment, a stopper block (not shown in figures) may be provided between the rotating shaft 51 and the stopper groove 61 to prevent the viewing window 3 from being rotated back during the upward rotation.

As a further modification of the present embodiment, the hinge component may also further includes an electric device for driving the hinge shaft 6 to automatically rotate, and the electric device may be arranged on the back surface of the fixed mounting plate 4. The electric device includes a stepping motor and a stepping driver, a stepping motor is driven by the stepper driver and the drive signal is preferably pulse signal.

In this embodiment, the rotation of the viewing window is achieved by the electric device. Specifically, when the stepper driver receives a pulse signal, it drives the stepper motor to rotate a certain angle along the set direction. The number of pulses could be adjusted to control the angular displacement of the stepper motor to accurately drive the viewing window rotating to set positions; the motor speed and acceleration is controlled by adjusting the frequency of the pulse, further to control the speed of rotation; the act of rotation of the viewing window could be controlled through the instant start and instant braking of the stepping motor.

The hinge component is provided with stopper and auxiliary elements to reduce the weight of the viewing window and to assist in the positioning of the stepper motor during the viewing window rotation. The setting of the stopper plate increases the support strength of the hinge shaft, and reduces the weight and the cost. If the fixed mounting plate is set to the same thickness as the stopper plate, it will increase the cost. In addition, the first and second stoppers are provided to prevent the hinge shaft in place from further rotating.

The above-described is intended only as a preferred embodiment of the present invention and is not intended to limit the scope of the invention in any way, and any person skilled in the art may use the technical contents disclosed herein to be modified or modified to be equivalent Examples. It is still within the scope of protection of the technical solution of the present invention without any modification, equivalence or modification of the above embodiments in accordance with the technical details of the present invention without departing from the scope of the technical solutions of the present invention.

What is claimed is:

1. A drum-type washing machine having a rotatable viewing window comprising: a front panel of a housing of the washing machine, an access opening provided on the front panel, and a viewing window disposed on the access opening, wherein a hinge component is provided between the viewing window and the front panel of the housing to allow the rotation of the viewing window along a horizontal orientation and along a vertical orientation to an open position;

wherein the hinge component includes a fixed mounting plate, a connecting arm, and a hinge shaft, wherein one end of the hinge shaft is provided with a hinge and the other end of the hinge shaft is provided with a hinge shaft rotation limiting device;

wherein the hinge further includes a connecting arm provided with a rotating shaft at its end and a stopper groove provided at the outer end surface of the hinge shaft, the rotating shaft of the connecting arm is disposed in the stopper groove;

and the hinge shaft rotation limiting device includes a brake arm and a stopper plate, wherein the brake arm is fixedly connected to the hinge shaft and the hinge shaft is movably connected to the stopper plate, and the stopper plate is fixedly connected to the fixed mounting plate.

2. The drum-type washing machine having a rotatable viewing window of claim 1, wherein the stopper groove is provided with a stop plane.

3. The drum-type washing machine having a rotatable viewing window of claim 1, wherein a stop block is disposed between the rotating shaft and the stopper groove.

4. The drum-type washing machine having a rotatable viewing window of claim 1, wherein the stopper plate is provided with a first stopper and a second stopper for positioning the stopper plate, wherein the first stopper and the second stopper are located on both sides of the hinge shaft respectively, the first stopper is provided with a spring and a button and the button is arranged on the front panel of the housing of the washing machine.

5. The drum-type washing machine having a rotatable viewing window of claim 4, wherein one end of the brake arm is provided with a groove-shaped structure that engages with the first stopper to block the brake arm.

6. The drum-type washing machine having a rotatable viewing window of claim 1, wherein the hinge component is fixed on the front panel through the fixed mounting plate; and the viewing window is fixed on the connecting arm.

7. The drum-type washing machine having a rotatable viewing window of claim 6, wherein the fixed mounting plate is fixed inside of the front panel of the housing.

8. The drum-type washing machine having a rotatable viewing window of claim 1, wherein the hinge shaft is provided with an electric device for automatically rotating the hinge shaft, and the electric device arranged at the back of the fixed mounting plate comprises a stepping motor and a stepping driver, wherein the stepping motor is driven by the stepping driver and the signal for driving is a pulse signal.

* * * * *